United States Patent [19]

Panter et al.

[11] Patent Number: 4,986,585

[45] Date of Patent: Jan. 22, 1991

[54] ANTI-THEFT GUARD FOR WING WINDOW LATCH SAFETY BUTTON

[76] Inventors: Scott C. Panter, 421 Nicole Cir., Wichita, Kans. 67233; Leon C. Van Vessum, 2021 Jeanette, Wichita, Kans. 67203

[21] Appl. No.: 487,216

[22] Filed: Mar. 1, 1990

[51] Int. Cl.[5] ..... E05B 13/00

[52] U.S. Cl. ..... 292/346; 292/DIG. 2; 292/DIG. 37; 292/DIG. 6

[58] Field of Search ..... 292/1, 346, 357, DIG. 2, 292/DIG. 6, DIG. 37, DIG. 38; 70/54, 55, 56, 417, 449, 452; 49/50, 56, 57

[56] References Cited

U.S. PATENT DOCUMENTS

| | | | |
|---|---|---|---|
| 1,705,706 | 3/1929 | Bartholomew | 292/DIG. 37 X |
| 1,784,935 | 12/1930 | Johnson | 292/DIG. 37 X |
| 2,560,477 | 7/1951 | Roethel | 292/DIG. 37 X |
| 2,603,515 | 7/1952 | Thomas | 292/DIG. 6 X |
| 2,694,917 | 11/1954 | Trammell, Jr. | 292/DIG. 2 X |
| 2,726,889 | 12/1955 | Lawson | 292/DIG. 37 X |
| 2,793,064 | 5/1957 | Budoff | 292/288 |
| 2,837,362 | 6/1958 | Meyer | 292/207 |
| 3,247,691 | 4/1966 | Martin | 292/DIG. 2 X |
| 3,722,935 | 3/1973 | Latib | 292/63 |
| 3,999,788 | 12/1976 | Livingston | 292/1 |
| 4,069,692 | 1/1978 | Hemphill | 292/DIG. 2 X |
| 4,101,155 | 7/1978 | Cohen | 292/347 |
| 4,124,239 | 11/1978 | Horton | 292/210 |
| 4,130,309 | 12/1978 | Lewis | 292/258 |
| 4,268,073 | 5/1981 | Hibbert | 292/113 |
| 4,695,081 | 9/1987 | Boykin | 292/96 |
| 4,842,312 | 6/1989 | Iwasaki et al. | 292/DIG. 37 X |

FOREIGN PATENT DOCUMENTS 1231678 5/1971 United Kingdom .

*Primary Examiner*—Eric K. Nicholson
*Attorney, Agent, or Firm*—John R. Flanagan

[57] ABSTRACT

An anti-theft guard for a wing window latch includes a hollow tubular sleeve and an anchoring element for releasably attaching the sleeve to the latch body. The sleeve is insertable at one open end over the latch body, and is of sufficient length to extend beyond the body and surround and shield a safety push button thereon from access except through an opposite open end of the sleeve. The sleeve has a longitudinal slot defined in a side portion extending from the one open end toward the opposite open but terminating short thereof. The slot has an outer portion located adjacent the one open end of the sleeve and an inner portion located remote therefrom and wider than the outer portion. The sleeve is composed of yieldably resilient flexible material allowing radial expansion thereof and of the outer slot portion to permit insertion of the sleeve over the latch body and passage of the latch lever through the outer portion and then snap-back radial contraction of the sleeve about the latch body and about the latch lever at the inner portion of the slot. The anchoring element is mounted to the sleeve adjacent its one open end and releasably secures the sleeve to the latch body. The anti-theft guard can be a separate component or, alternatively, formed integral with the latch body.

18 Claims, 2 Drawing Sheets

ANTI-THEFT GUARD FOR WING WINDOW LATCH SAFETY BUTTON

BACKGROUND OF THE INVENTION

1. Field of the Invention

The present invention generally relates to vehicle anti-theft devices and, more particularly, is concerned with an anti-theft guard for shielding a safety push button of a vehicle wing window latch.

2. Description of the Prior Art

Many vehicles, such as pickup trucks, are equipped with wing windows. Such windows are swingably mounted to the door frame and, in turn, mount latches used to lock the wing windows in closed positions to the door frame. The latch typically has a handle or lever which is rotated to actuate the latch between latched and unlatched conditions. The latch ordinarily includes a safety push button which must be depressed and the lever rotated at the same time to open the wing window.

It is highly desirable to make it difficult for someone to break into the vehicle. However, access can be gained relatively easily past the edge of a wing window pane from the outside. By use of an appropriately bent wire the safety push button can be depressed and the latch lever pivoted simultaneously to unlatch and open the wing window. Such wire which must be relatively rigid to work properly is readily available on many vehicles in the form of a master brake cylinder cap retainer which snaps on and off with ease.

Many different anti-theft devices have been proposed in the prior art to prevent breaking into a vehicle through a wing window. Representative of the prior art devices are the ones disclosed in Latib U.S. Pat. No. 3,722,935, Horton U.S. Pat. No. 4,124,239, Lewis U.S. Pat. No. 4,130,309, Hibbert U.S. Pat. No. 4,268,073and Boykin U.S. Pat. No. 4,695,081 and in McKinlay British Pat. No. 1,231,678. These anti-theft devices all have one major drawback. They interfere with normal use of the wing window. Thus, they must be removed before the wing window can be unlatched and opened. As a result, the tendency is that users may forget to reattach the devices before leaving their vehicles.

Consequently, a need exists for a different antitheft device design which will avoid the drawback of prior art devices.

SUMMARY OF THE INVENTION

The present invention provides an anti-theft guard designed to satisfy the aforementioned needs. Unlike the prior art devices, the anti-theft guard of the present invention does not have to be removed to actuate the wing window latch. The guard does not lock the wing window to the door frame. Instead, it shields the safety push button from being depressed using a bent wire after the end of wire is extended from outside to inside the vehicle past the edge of the wing window pane and then positioned across the button. However, the guard permits a person inside of the vehicle to easily depress the push button and rotate the latch handle to open the wing window.

Accordingly, the present invention is directed to an anti-theft guard for the latch of a vehicle wing window. The latch is of the type having a body mounted to the wing window, a lever mounted to and extending from a side of the body, and a safety push button mounted to and extending axially from the body. The latch body is rotatable about an axis extending generally normal to the wing window. The lever is pivotal about the axis of the latch body between latching and unlatching positions. The push button is movable along the axis of the latch body upon being manually depressed to thereby permit rotating of the body and pivoting of the lever from the latching to unlatching position to permit opening of the wing window.

The anti-theft guard of the present invention comprises a hollow tubular sleeve open at its opposite ends for insertion at one open end over the latch body. Also, the sleeve is of sufficient length to extend beyond the latch body and shield the latch push button from access except through the opposite open end of the sleeve. Further, the sleeve has a longitudinal cutout or slot defined in a side portion thereof extending from the one open end toward the opposite open end but terminating short thereof. The slot is provided for passage of the latch lever through it when the sleeve is inserted over the latch body such that the sleeve is carried by the body and lever when the body is rotated and the lever is pivoted between the latching and unlatching positions.

The slot in the sleeve has an outer portion located adjacent the one open end of the sleeve and an inner portion located remote from the one open end and being wider than the outer portion of the slot. The sleeve is composed of yieldably resilient flexible material allowing radial expansion of the sleeve and of the outer portion of the slot for permitting insertion of the sleeve over the latch body and passage of the latch lever through the outer slot portion and then snap-back radial contraction of the sleeve about the latch body and about the latch lever at the inner portion of the slot. The flexible character of the sleeve and the configuration of its slot provide the primary means for retention of the sleeve on the latch body.

Further, the anti-theft guard comprises anchoring means mounted to the sleeve for securing the sleeve to the latch body when inserted over the body. Two different embodiments of the anchoring means are disclosed. In one embodiment, the anchoring means is an double-sided adhesive pad attached to an interior surface of the sleeve adjacent the one open end thereof. In the other embodiment, the anchoring means includes a hole defined in the sleeve adjacent its one open end and a set screw threadable through the hole for engaging the latch body.

Still further, in the preferred embodiment of the present invention, the anti-theft guard is a separate component from the latch. In an alternative embodiment of the invention, the guard is formed integral with the latch body. The guard provides an annular rim which projects from the body and shieldably surrounds the push button.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
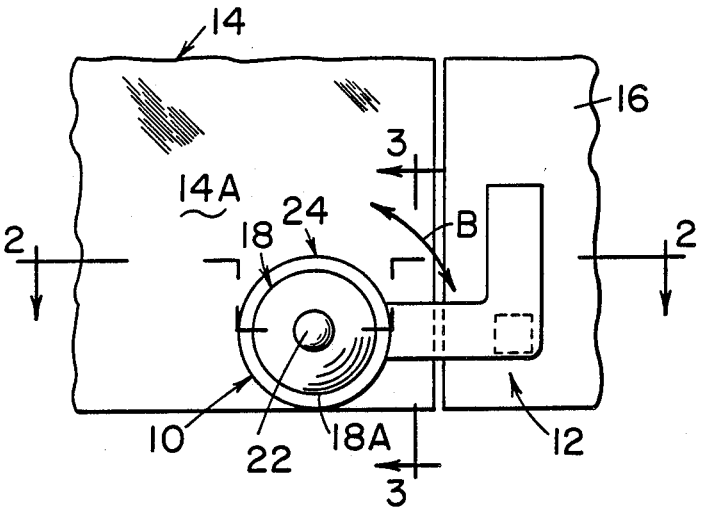
FIG. 1 is a front elevational view of a vehicle wing window latch mounting a preferred embodiment of an anti-theft guard in accordance with the present invention.
Figure 2:
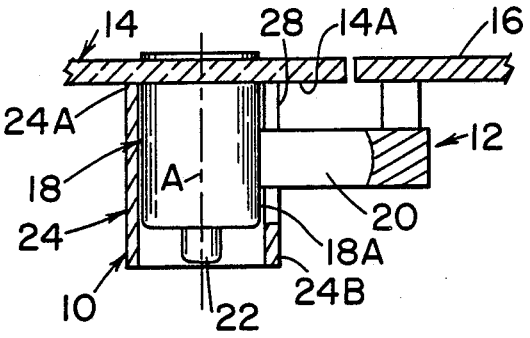
FIG. 2 is a side elevational view of the wing window latch and anti-theft guard as seen along line 2—2 of FIG. 1.
Figure 3:
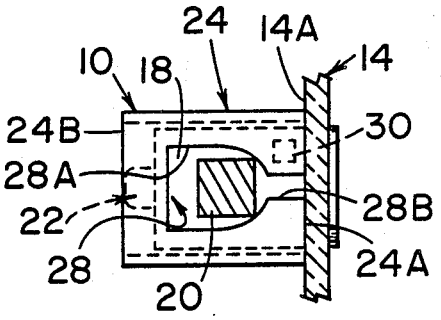
FIG. 3 is another side elevational view of the wing window latch and anti-theft guard as seen along line 3—3 of FIG. 1.

Referring to the drawings, and particularly to FIGS. 1-3, there is shown a preferred embodiment of an anti-theft guard, generally designated by the numeral 10, applied to a conventional latch 12 of a conventional vehicle wing window 14. The wing window 14 is swingably mounted to a door frame (not shown) of the vehicle (not shown). The latch 12, in turn, is mounted to the rear lower corner of the wing window 14 so as to project from the interior surface 14A thereof into the interior of the vehicle. The latch 12 is used to lock the wing window 14 in a closed position, as seen in FIGS. 1 and 2, to a frame member 16 of the door frame.

The conventional wing window latch 12 is of the type having a cylindrical body 18 mounted to the wing window 14, a handle or lever 20 mounted to and extending from a side of the body 18, and a safety push button 22 mounted to and extending axially from the body 18. The latch body 18 is rotatable about an axis A extending substantially perpendicular or normal to the wing window 14. The latch lever 20 is pivotal about the axis A of the latch body 18 between latching and unlatching positions. The latch push button 22 is movable along the axis A of the latch body 18 upon being manually depressed to thereby permit rotating of the body 18 and pivoting of the lever 20. Upon being released, the button 22 is spring-loaded to return to its initial extended position seen in FIG. 2. The lever 20 is pivotal in the direction of the arcuate double-headed arrow B in FIG. 1 between the lower latching position (FIGS. 1 and 2) in which the lever 20 overlaps the frame member 16 and blocks outward swinging of the wing window 14 from its closed position, and an upper unlatching position (not shown) in which the lever 20 is clear of the frame member 16 and permits outward swinging and opening of the wing window. 14

In its basic components, the anti-theft guard 10 of the present invention includes a hollow tubular sleeve 24 preferably of cylindrical shape and open at its opposite ends 24A and 24B for insertion via its one open end 24A over the latch body 18, and an anchoring element 26 mounted to the sleeve 24 for releasably securing the sleeve 24 to the latch body 18 once inserted over the body. The sleeve 24 is of sufficient length to extend beyond the latch body 18 and surround and shield the latch push button 22 from access except through the opposite open end 24B of the sleeve, such as by a user's finger inserted through the sleeve open end 24B.

Figure 5:
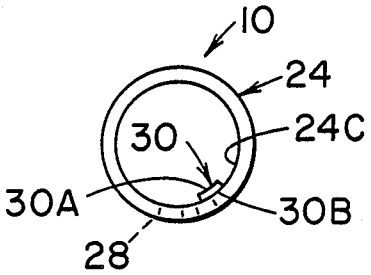
FIG. 5 is a top plan view of the preferred embodiment of the anti-theft guard as seen along line 5—5 of FIG. 4.
Figure 4:
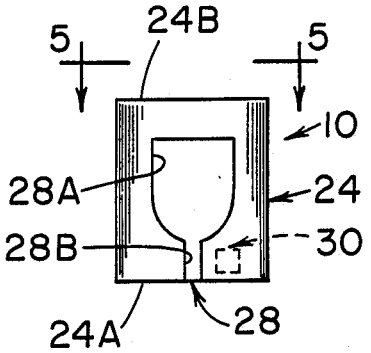
FIG. 4 is a side elevational view of the preferred embodiment of the anti-theft guard by itself.

Also, referring to FIGS. 4 and 5, the sleeve 24 has a longitudinal cutout or slot 28 defined in a side portion thereof extending from the one open end 24A toward the opposite open end 24B but terminating short thereof. The slot 28 is provided for passage of the latch lever 20 through it when the sleeve 24 is inserted over the latch body 18. The sleeve 24 is thus carried by the latch body 18 and lever 20 when the body is rotated and the lever is pivoted between the latching and unlatching positions.

More particularly, the slot 28 in the sleeve 24 has an inner portion 28A and an outer portion 28B. The outer portion 28B is located adjacent the one open end 24A of sleeve, whereas the inner portion 28A is located remote therefrom. The inner portion 28A of the slot 28 is substantially wider than the outer portion 28B thereof. The sleeve 24 is composed of yieldably resilient flexible material, such as a suitable plastic. Such flexible material allows radial expansion of the sleeve 24 and of the outer portion 28B of the slot 28 to permit insertion of the sleeve 24 over the latch body 18 and passing of the latch lever 20 through the outer slot portion 28B and then snap-back radial contraction of the sleeve 24 about the latch body 18 and about the latch lever 20 at the inner portion 28A of the slot 28. The flexible character of the sleeve 24 and the configuration of its slot 28 provide the primary means for retention of the sleeve 24 on the latch body 18.

The anchoring element 26 of the anti-theft guard 10 is a secondary means for securing the sleeve 24 to the latch body 18 once the sleeve 24 has been inserted over and fitted about the latch body 18 and lever 20. Two embodiments of the anchoring element 26 are disclosed. In the preferred embodiment seen in FIGS. 4 and 5, the anchoring element 26 is in the form of an double-sided adhesive pad 30. The pad 30 at its inner side 30A is adhered to an interior surface 24C of the sleeve 24 adjacent the one open end 24A thereof. When inserted over the latch body 18, the pad 30 at its outer side 30B will releasably adhere to the outer surface 18A of the body 18.

Figure 7:
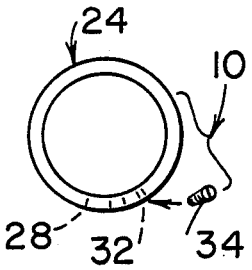
FIG. 7 is a top plan view of the alternative embodiment of the anti-theft guard as seen along line 7—7 of FIG. 6.
Figure 6:
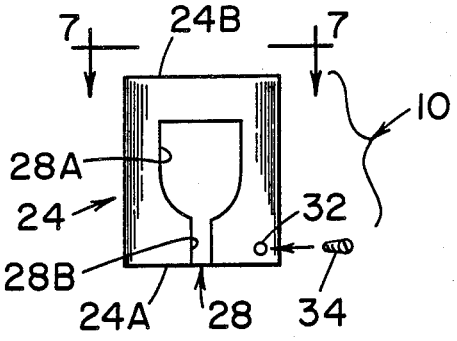
FIG. 6 is a side elevational view of an alternative embodiment of the anti-theft guard of the present invention.

In the alternative embodiment seen in FIGS. 6 and 7, the anchoring element 26 includes a hole 32 defined in the sleeve 24 adjacent its one open end 24A and a set screw 34 threadable through the hole 32 for engaging the outer surface 18A of the latch body 18. By tightening down the set screw 34, it makes contact with the latch body 18 and secures the sleeve 24 thereon.

In the preferred embodiment of the present invention just described and as seen in FIGS. 1-7, the anti-theft guard 10 is a separate component from the latch 12 and thus can be used to retrofit wing window latches on vehicles presently in use. It should be understood that the specific shapes of the sleeve 24 and slot 28 of the separate anti-theft guard 10 is contingent upon the configuration of the particular wing window latch 12 being fitted by the guard 10.

Figure 8:
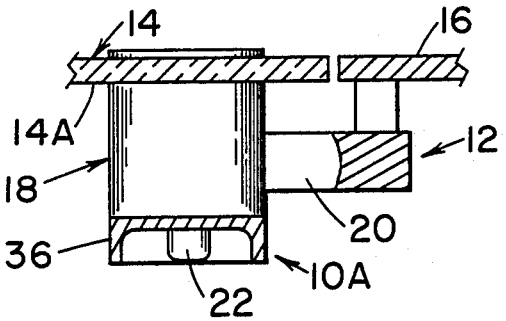
FIG. 8 is a side elevational view of the wing window latch and an alternative embodiment of the anti-theft guard in accordance with the present invention.

In an alternative embodiment of the invention seen in FIG. 8, the anti-theft guard 10A is formed integral with the latch body 18 and thus can be incorporated in wing window latches of new vehicles and in latches of replacement wing windows for vehicles currently in use. In particular, the guard 10A is provided in the form of a continuous annular rim 36 which projects from the cylindrical latch body 18 and surrounds the push button 22, shielding it in the same manner as in the case of the separate sleeve 24 of the preferred embodiment of the anti-theft guard 10.

Thus, in both embodiments of the anti-theft guard 10 and 10A, either a continuous annular-shaped inner end 24B or rim 36 is provided which is radially spaced outwardly from and shields the safety push button 22. Due to the presence of the continuous inner end 24B or rim 36 which extends about and is spaced laterally from all sides of the push button, the button 22 cannot be depressed using a bent wire after the end of wire has been worked and extended from outside to inside the vehicle past the edge 14B of the pane of the wing window 14 and then positioned across the button 22. However, both embodiments of the guard 10 and 10A still permit a person inside of the vehicle to easily depress the push button 22 and rotate the latch handle or lever 20 to open the wing window 14.

It is thought that the present invention will be apparent that various changes may be made thereto without departing from its spirit and scope or sacrificing all of its material advantages, the form hereinbefore described being merely preferred or exemplary embodiment thereof.

Having thus described the invention, what is claimed is:

1. An anti-theft guard for use with a latch of a vehicle wing window of the type having a body mounted to the wing window for rotation about an axis extending generally normal to the wing window, a lever mounted to and extending from a side of the latch body for pivotal movement about the axis of the body between latching and unlatching positions, and a push button mounted to and extending axially from the latch body for movement along the axis of the body upon being manually depressed to thereby permit rotating of the body and pivoting of the lever from the latching to unlatching position to permit opening of the wing window, said anti-theft guard comprising:

a hollow tubular sleeve open at its opposite ends for insertion at one open end over the latch body and being of sufficient length to extend beyond the body and shield the button from access except through the opposite open end of the sleeve;

said sleeve having a longitudinal slot defined in a side portion thereof for passage therethrough of the latch lever when said sleeve is inserted over the latch body such that said sleeve is carried by the latch body and lever when the body is rotated and the lever is pivoted between the latching and unlatching positions.

2. The anti-theft guard of claim 1, wherein said slot in said sleeve extends from said one open end toward said opposite open end thereof but terminates short of said opposite open end.

3. The anti-theft guard of claim 1, wherein said slot in said sleeve has an inner portion located remote from said one open end of said sleeve and an outer portion located adjacent said one open end thereof, said inner portion of said slot being wider than said outer portion thereof.

4. The anti-theft guard of claim 3, wherein said sleeve is composed of yieldably resilient flexible material allowing radial expansion of said sleeve and of the outer portion of said slot for permitting insertion of said sleeve over the latch body and passage of the latch lever through said outer slot portion and then snap-back radial contraction of said sleeve about the latch body and about the latch lever at the inner portion of said slot, the flexibility of said sleeve and the configuration of its slot providing the primary means for retention of said sleeve on the latch body.

5. The anti-theft guard of claim 1, further comprising anchoring means mounted to said sleeve for releasably securing said sleeve to the latch body when inserted over the body.

6. The anti-theft guard of claim 5, wherein said anchoring means is a double-sided adhesive pad being attached on an inner side to an interior surface of said sleeve and releasably attachable on an outer side to the latch body when said sleeve is inserted over the body.

7. The anti-theft guard of claim 5, wherein said anchoring means includes:

means defining a hole in said sleeve adjacent its one open end; and a set screw threadable into said sleeve through said hole for engaging the latch body when said sleeve is inserted over the body.

8. In combination with a latch of a vehicle wing window having a latch body mounted to the wing window for rotation about an axis extending generally normal to the wing window, a lever mounted to and extending from a side of the latch body for pivotal movement about the axis of the latch body between latching and unlatching positions, and a push button mounted to and extending axially from the latch body for movement along the axis of the cylinder upon being manually depressed to thereby permit rotating of the latch body and pivoting of the lever from the latching to unlatching position to permit opening of the wing window, an anti-theft guard comprising:

means on said latch body defining an annular-shaped end portion on said latch body projecting outwardly therefrom along the axis of said latch body and radially spaced outwardly from and surrounding said push button for shielding said push button, said annular-shaped end portion terminating in a continuous annular rim defining an outer open end on said annular-shaped end portion, said continuous annular rim extending about and spaced laterally from all sides of said push button so as to shield bout push button from access except through said outer open end of said annular rim.

9. The anti-theft guard of claim 8, wherein said shielding means is formed integral with said latch body.

10. The anti-theft guard of claim 8, wherein said shielding means is a hollow tubular sleeve separate from and inserted over said latch body and said annular end portion is an end portion of said sleeve.

11. The anti-theft guard of claim 10, wherein said sleeve is open at its opposite end for insertion at one open end over said latch body and is of sufficient length so that said sleeve at said annular end portion thereof extends beyond said body and surrounds and shields said button from access except through the opposite open end of said sleeve, said opposite open end of said sleeve being said outer open end of said continuous annular rim on said annular end portion thereof.

12. In combination with a latch of a vehicle wing window having a latch body mounted to the wing window for rotation about an axis extending generally normal to the wing window, a lever mounted to and extending from a side of the latch body for pivotal movement about the axis of the latch body between latching and unlatching positions, and a push button mounted to and extending axially from the latch body for movement along the axis of the latch body upon being manually depressed to thereby permit rotating of the latch body and pivoting of the lever from the latching to unlatching position to permit opening of the wing window, an anti-theft guard comprising:

means on said latch body defining an annular-shaped portion on said latch body projecting therefrom and radially spaced outwardly from and surrounding said push button for shielding said push button;

said shielding means being a hollow tubular sleeve separate from and inserted over said latch body and said annular portion being an end of said sleeve;

said sleeve being open at its opposite ends for insertion at one open end over said latch body and of sufficient length so that said sleeve at said annular end portion thereof extends beyond said body and surrounds and shields said button from access except through the opposite open end of said sleeve;

said sleeve having a longitudinal slot defined in a side portion thereof through which passes said latch lever such that said sleeve is carried by said latch body and lever when said body is rotated and said lever is pivoted between the latching and unlatching positions.

13. The anti-theft guard of claim 12, wherein said slot in said sleeve extends from said one open end toward said opposite open end thereof but terminates short of said opposite open end.

14. The anti-theft guard of claim 12, wherein said slot in said sleeve has an inner portion located remote from said one open end of said sleeve and an outer portion located adjacent said one open end, said inner portion of said slot being wider than said outer portion thereof.

15. The anti-theft guard of claim 14, wherein said sleeve is composed of yieldably resilient plastic material allowing expansion of said sleeve and of the outer portion of said slot for permitting insertion of said sleeve over the latch body and passage of the latch lever through said outer slot portion and then snap-back contraction of said sleeve about the latch body and about the latch lever at the inner portion of said slot, the flexibility of said sleeve and the configuration of its slot providing the primary means for retention of said sleeve on the latch body.

16. The anti-theft guard of claim 12, further comprising anchoring means mounted to said sleeve for releasably securing said sleeve to said latch body.

17. The anti-theft guard of claim 16, wherein said anchoring means is a double-sided adhesive pad being attached on an inner side to an interior surface of said sleeve and releasably attached on an outer side to said latch body.

18. The anti-theft guard of claim 16, wherein said anchoring means includes:

means defining a hole in said sleeve adjacent its one open end; and a set screw threaded into said sleeve through said hole and engaging said latch body.

* * * * *